US005453656A

United States Patent [19]

Ui

[11] Patent Number: 5,453,656

[45] Date of Patent: Sep. 26, 1995

[54] DISCHARGE LAMP ASSEMBLY

[75] Inventor: Takahiro Ui, Gunma, Japan

[73] Assignee: Asahi Electric Works, Ltd., Maebashi, Japan

[21] Appl. No.: 280,323

[22] Filed: Jul. 25, 1994

[30] Foreign Application Priority Data

Aug. 17, 1993 [JP] Japan ..... 5-203073

[51] Int. Cl.[6] ..... H01J 5/54

[52] U.S. Cl. ..... 313/318.12; 313/318.07; 313/318.08; 439/602; 439/611

[58] Field of Search ..... 313/318, 51, 318.05, 313/318.07, 318.08, 318.12, 51; 439/602, 611, 617

[56] References Cited

U.S. PATENT DOCUMENTS

| | | | |
|---|---|---|---|
| 4,533,851 | 8/1985 | Block et al. | 313/318 X |
| 4,547,838 | 10/1985 | Wakimizu | 362/211 |
| 4,868,456 | 9/1989 | Sanders et al. | 313/318 X |
| 5,150,008 | 9/1992 | Lee | 313/318 X |
| 5,216,318 | 6/1993 | Van Dulmen et al. | 313/318 X |

FOREIGN PATENT DOCUMENTS

| | | |
|---|---|---|
| 0231936A2 | 8/1987 | European Pat. Off. . |
| 0376260A2 | 7/1990 | European Pat. Off. . |
| 2661275 | 4/1991 | France . |
| 6060802 | 3/1994 | Japan . |

*Primary Examiner*—Sandra L. O'Shea
*Assistant Examiner*—Ashok Patel
*Attorney, Agent, or Firm*—Nikaido, Marmelstein, Murray & Oram

[57] ABSTRACT

A discharge lamp assembly compatible with a conventional filament type vehicle lamp has a discharge lamp, and a base structure with a first base component made of ceramics and a second base component made of plastics. The first base component has a cylindrical tube having a height at center of the component for accepting the lamp together with a positive lead line of the lamp into the hole under the cylindrical tube, a hole at side of the component for accepting a negative lead line of the lamp, and a slit between the holes. A first partition wall is provided between the slit and the hole. The second base component has a circular flange and a hollow housing under the flange which engages with the first base component. A second partition wall is provided in the housing so that the second partition wall engages with the slit of the first base component when assembled. The cylindrical tube, first partition wall and second partition wall function to increase insulation length between a positive lead line and a negative lead line to ensure that it will withstand voltage higher than 20000 V.

10 Claims, 8 Drawing Sheets

DISCHARGE LAMP ASSEMBLY

BACKGROUND OF THE INVENTION

The present invention relates to a discharge lamp assembly, in particular, relates to a base structure of the lamp assembly of a discharge lamp for feeding electric power to the lamp. The present invention relates to such a base structure in which a discharge lamp which a base is mounted operates with higher than 20000 volts with no leakage due to undesirable discharge in air and along the base structure itself. The present lamp assembly is preferably used in a head lamp of a vehicle. Preferably, a discharge lamp having the present base structure is compatible with a conventional type socket which is used in a conventional filament type lamp in a head light assembly for a vehicle.

A filament type lamp using tungsten filament has been used for a head light lamp in a vehicle.

Lately, a so-called projector type or ellipsoid head light using a halogen lamp (for instance, an iodine lamp) which has advantages to prevent a lamp wall blackened by halogen cycle and to have long life of a filament has been used in a head light of a vehicle. The lamp is almost a point light source, which is accompanied by a reflector for condensing light.

A technical standard has been determined for such a projector type head light. Some of them are PE (Polyellipsoid), and DE (three-dimentional ellipsoid), in which structure and dimension of a base or a connector are defined for each halogen lamp (H-1 type, or H-7 type, HB-3 type and/or HB-4 type, et al).

A prior halogen lamp for a projector type head light is supplied with electric power of 12 volts, consumes 50–100 watts, having the light conversion efficiency 20–23 lm/W, and average life time 500 hours.

FIG. 8 shows the structure of a prior halogen lamp assembly 100 (H-1 type), and a socket 8 of a projector type head light for accepting said lamp assembly 100.

In the figure, the lamp assembly 100 has a halogen lamp 1, which is fixed to a base 2 through a column 3. The numeral 4 is a flange for fixing the lamp assembly 100 to the socket 8, and 5 is an electrode for feeding electric power to the lamp 1. The halogen lamp 1 operates with low voltage around 12 volts, therefore, no specific consideration for insulation is necessary. The base 2 of the lamp 1 has a column 3 made of plastics, and a flange 4 made of conductive material which doubles as a negative electrode.

A socket assembly 7 has a socket 8 which has a conductive bottom plate 8*a*. The bottom plate 8*a* has a hole 9 to which the lamp 1 and the column 3 pass, and a pair of small holes (9*a*, 9*b*) for accepting projections 4*a* on the flange 4 of said lamp assembly 100 so that the lamp assembly 100 is positioned. The lamp assembly 100 is fixed or positioned on the bottom plate 8*a*, so that the flange 4 contacts with the bottom plate 8*a*. And a pair of springs 11 push the flange 4 so that the lamp assembly 100 is fixed on the bottom plate 8*a*. A hook 12 is engaged with the end of the springs 11 so that the lamp assembly 100 is tightly fixed or supported on the bottom plate 8*a*.

On the other hand, a discharge lamp which replaces a prior halogen lamp is studied for a head light of a vehicle.

A discharge lamp has higher light conversion efficiency up to 100 lm/W, and provides brightness several times as high as a conventional halogen lamp. Further, consumed power is only 35 W or so, and life time is more than four times as long as a halogen lamp. Therefore, a discharge lamp saves much energy, and it is an ideal lamp for a head lamp of a vehicle.

A discharge lamp for a vehicle is commercially available in the tradename XENARC by OSRAM in Germany. Philips Company in Holland also supplies such a discharge lamp in the tradename MICRO POWER LIGHT.

However, as a discharge lamp must use high voltage around 20000 volts, structure for insulation must be considered when it is used as a head light of a vehicle. The structure of a base of a discharge lamp must satisfy the requested specification for insulation.

Conventionally, a base for a discharge lamp for a vehicle is designed in specific size so that spacing between electrodes and length between a positive electrode and an outside ground withstand high voltage higher than 20000 volts.

However, said conventional base structure for a discharge lamp is different in structure and size from those of a conventional filament type head lamp, because of insulation problem for high voltage.

Said conventional base structure for a discharge lamp is comprised of a member of ceramics and a member of metal, or a member of plastics and a member of metal, and has relatively large volume so that leakage and/or discharge due to high voltage, and/or high temperature of a lamp are avoided.

Therefore, it has been impossible to mount a discharge lamp assembly into a conventional socket for a filament type head light. When we use a discharge lamp as a head light for a vehicle, we must develop not only a socket for accepting a discharge lamp, but also a peripheral components which match with the socket.

However, the use of a specific large socket for a discharge lamp, together with peripheral components has the disadvantage of cost for developing some components, and it takes some time for developing, resulting delay of use of a discharge lame as a head light.

SUMMARY OF THE INVENTION

It is an object, therefore, of the present invention to overcome the disadvantages and limitations of a prior discharge lamp assembly by providing a new and improved discharge lamp assembly.

It is also an object of the present invention to provide a discharge lamp assembly which is compatible with a conventional filament type lamp, and is engaged with a socket for a conventional filament type lamp.

It is also an object of the present invention to provide a discharge lamp assembly so that a discharge lamp is used in a conventional socket for H-1, H-7, HB-3/HB-4 halogen lamp.

The above and other objects are attained by a discharge lamp assembly having a discharge lamp (15) and a base structure (14, 40) for fixing said discharge lamp, said base structure comprising; a first base component (22) made of integral ceramics comprising a cylindrical tube (16) having a predetermined height (b) at center of said first base component for accepting said discharge lamp (15) at the other side of the first base component (22), a first hole (22*a*) at bottom of one side of said first base component (22) for accepting an external positive lead line (26), a second hole (22*b*) under said cylindrical tube (16) for accepting a positive lead line (20) of said discharge lamp (15), a third hole (22*c*) for accepting a negative lead line (17) of a discharge lamp (15), a first partition wall (21) provided between said second hole and said third hole for insulating a positive line and said negative lead line, and a slit (22*d*) between said second hole and said third hole adjacent to side of said first partition wall (21); a second base component (30) made of integral plastics for engaging with said first base component (22), comprising a circular flange (24) and a housing (24*b*) under said flange (24) having a bottom plate for accepting said first base component (22), a pair of tubes (28*a*, 28*b*) under said bottom plate for accepting external lead lines for said discharge lamp, and a second partition wall (29) for insulating said positive lead line and said negative lead line so said said second partition wall (29) engages with said slit (22*d*); wherein length (X1, X2) between said positive lead line and outer wall of the base structure, and length between said positive lead line and said negative lead line are in range between 20 mm and 30 mm, and said base structure is compatible with a conventional filament type head light.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
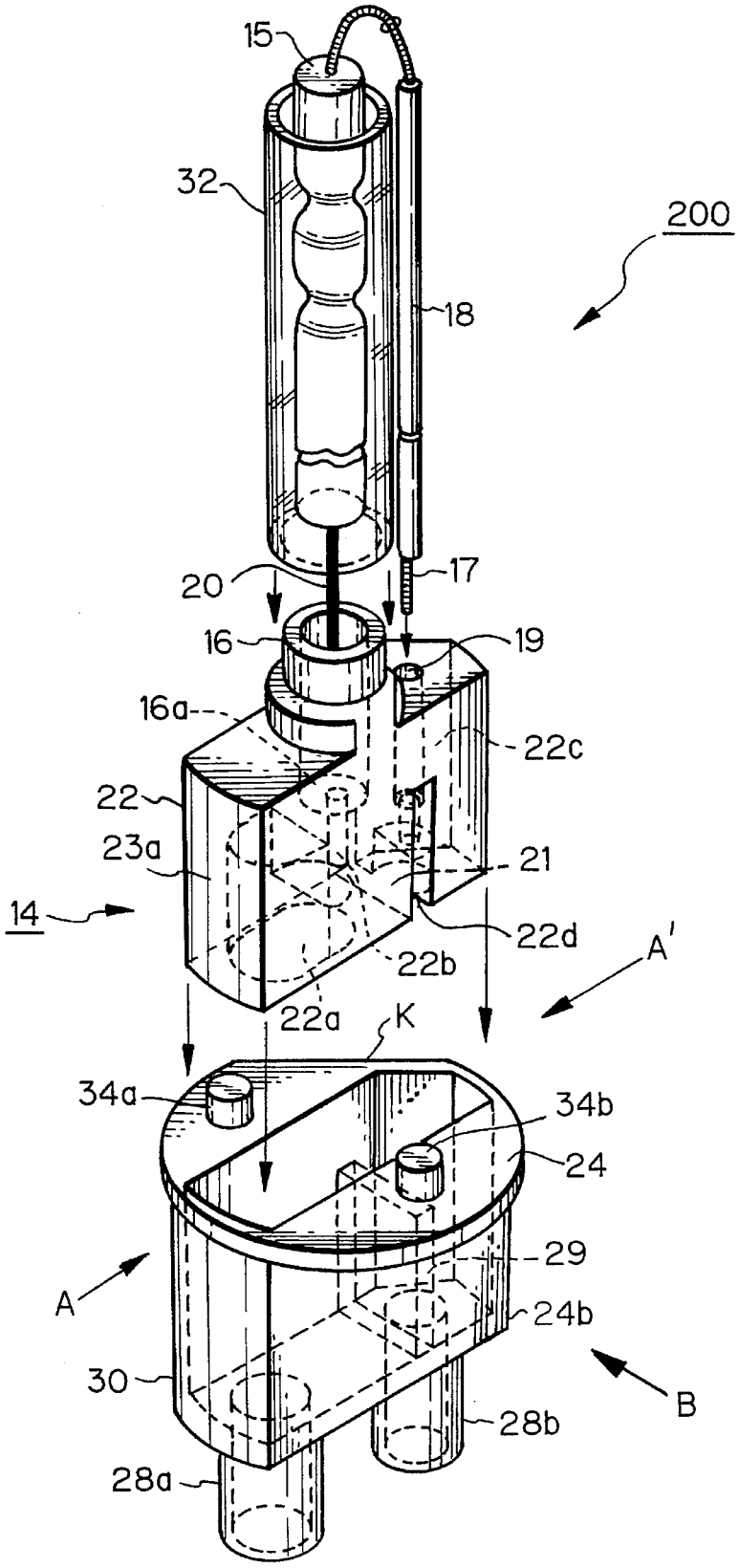
FIG. 1 shows structure of a discharge lamp assembly which is compatible with a socket for a conventional H-1 type halogen lamp for a filament type head light.

FIG. 1 shows a perspective view of a discharge lamp assembly which has a base structure compatible with a socket for a H-1 filament type halogen lamp.

Figure 2:
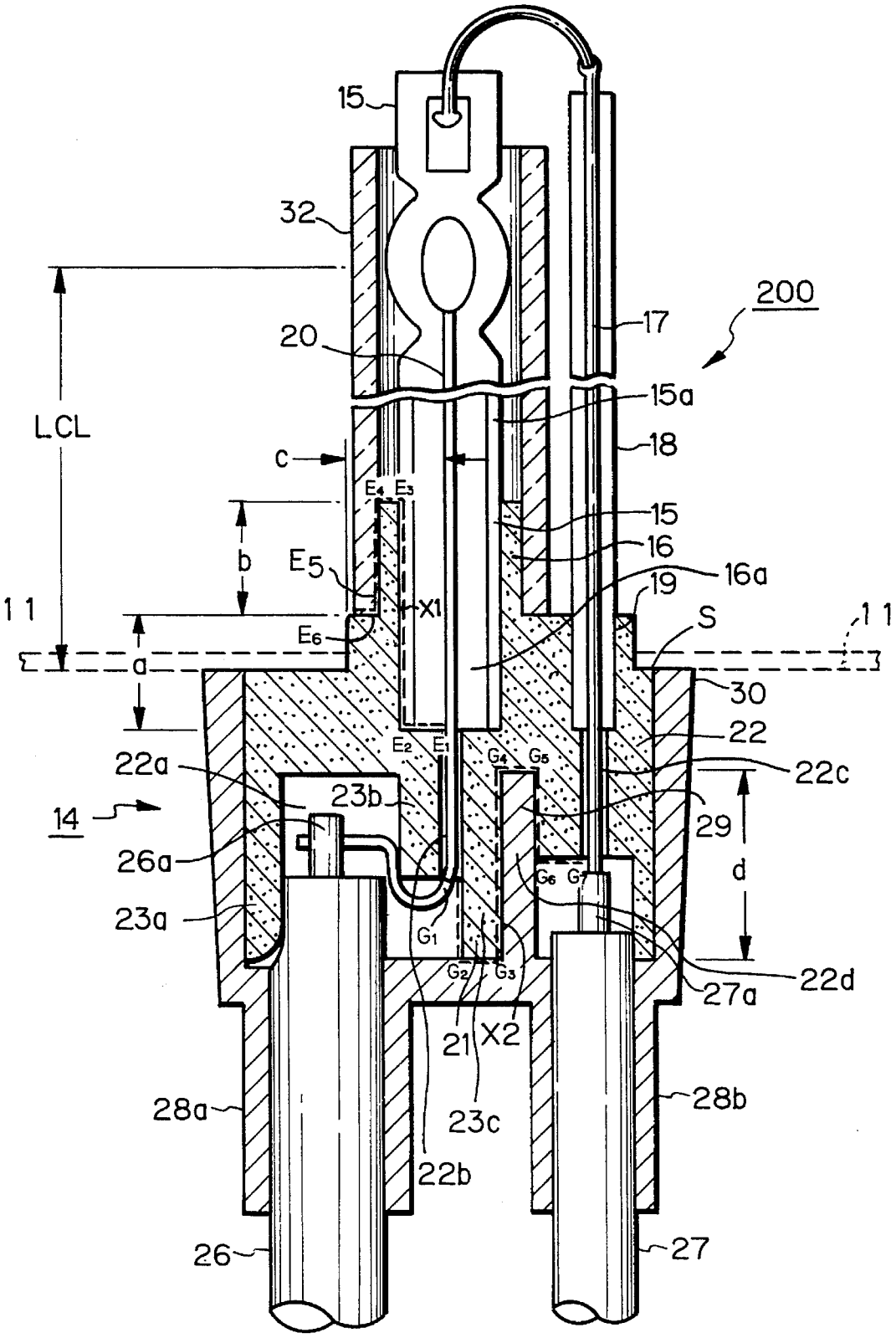
FIG. 2 shows cross section along A—A' of FIG. 1.

FIG. 2 shows cross section along A—A' viewing from direction B.

The discharge lamp assembly 200 in FIGS. 1 and 2 comprises an elongated discharge lamp 15 having a positive lead line 20 and a negative lead line 17, a first base component 22 which supports said lamp 15, and a second base component 30 which engages with said first base component 22.

The first base component 22 and the second base component 30 compose the base structure 14. The hole 22*a* is at the bottom of the first base component 22 and does not pass through the first base component 22. The holes 22*b* and 22*c* pass through the same.

The first base component 22 is made of ceramics, and essentially in rectangular shape with bulk structure having a short cylindrical tube 16 having a predetermined height (b) at the center of the first base component 22. A hole 16*a* having a depth (a) is provided under said cylindrical tube 16. The diameter of the hole 16*a* is the same as the inner diameter of the cylindrical tube 16. The first base component 22 has a relatively large first hole 22*a* which accepts an external positive lead line 26 at the bottom of the first base component 22 at one side of the base component 22, a relatively thin second hole 22*b* which passes through the component 22 from top to bottom for accepting the positive lead line 20 at center of the base component 22, a relatively thin third hole 22*c* which passes through the component 22 from top to bottom for accepting a negative lead line 17 at the other side of the base component 22, and a rectangular slit 22*d* which engages with an insulation wall 29 of a second base component 30 (as described later).

The first hole 22*a* is defined by an external wall 23*a* which extends the whole length or height of the component 22, and an inner wall 23*b* which is shorter than the external wall 23*a* so that an empty space is provided under the inner wall 23*b*. That empty space is used to couple the positive lead line 20 with the external lead line 26.

The third hole 22*c* has a relatively large portion 19 at the top of the component 22 so that a thin ceramics pipe 18 which encloses a negative lead line 17 is engaged, and another relatively large portion at the bottom of the component 22 so that an external negative lead line 27 is accepted. The portion between those relatively large portions is thin only for accepting a negative lead line 17.

The slit 22*d* is provided at the bottom of the first base component 22 between the second hole 22*b* at the center and the third hole 22*c*, and is defined by the walls around said holes 22*b* and 22*c*. One wall 23*c* at the side of the slit 22*d* toward the second hole 22*b* extends the whole length of the first component 22, and functions as a first partition wall 21, which operates to increase insulation length between the positive lead line and the negative lead line.

The second base component 30 is made of integral plastics having an arc shaped flange 24 and an essentially rectangular hollow housing 24*b* which engages with said first base component 22.

The flange 24 has a pair of small projections 34*a* and 34*b* which engage with holes 9*a* and 9*b* (see FIG. 8) of a conventional filament type socket for positioning the lamp assembly in the socket. The projections 34*a* and 34*b* locate separately at both sides of the housing 24*b*.

The rectangular hole defined by the housing 24*b* is separated by a second partition wall 29 which is integral with the second base component 30. The second partition wall 29 is engaged with the slit 22*d* of the first base component 22 when two base components 22 and 30 are assembled. The first partition wall 21 and the second partition wall 29 touch with each other when assembled as shown in FIG. 2.

The second base component 30 has a pair of pipes 28*a* and 28*b* under a bottom plate of the second base component 30 integral with the component 30 for accepting external lead lines 26 and 27. Those pipes 28*a* and 28*b* are located under the holes 22*a* and 22*c*, respectively.

The diameter of the flange 24 is around 24 mm, and the flange 24 has the cutout portion K for the compatibility with a conventional H-1 filament lamp. The housing 24 has also a cutout portion relating to that of the flange 24.

In assembling, The lamp 15 is engaged with the cylinder 16 of the first base component 22. The positive lead line 20 passes through the second hole 22*b* at the center of the first base component 22, and the negative lead line 17 passes through the third hole 22*c* at the side of the first base component 22. Preferably, the negative lead line 17 is covered with the ceramics pipe 18 between the first base component 22 and the top of the lamp 15.

The external lead lines 26 and 27 are engaged with the pipes 28*a* and 28*b*, respectively, of the second base component 30. Then, the end of the positive lead line 20 is spot-welded to the top 26*a* of the external positive lead line 26, and the end of the negative lead line 17 is spot-welded to the end 27*a* of the external negative lead line 27.

Then, the second base component 30 is engaged with the first base component 22 so that the first base component 22 is inserted in the hole of the second base component 30.

Preferably, the transparent insulation tube 32 made of glass covers the discharge lamp 15 for the whole length of the lamp 15 and is engaged with said cylindrical tube 16 of the first base component 22.

In the above structure, the insulation length X1 from the bare portion of the positive lead line 20 or the positive external lead line 26 exposing conductive metal to an external point of the base structure, and the length X2 from the positive lead line 20 and the negative lead line 21 are designed so that both X1 and X2 are in the range between 20 mm and 30 mm for providing withstand voltage higher than 20000 V. In FIG. 2, the insulation length X1 from the positive lead line 20 to the external point $E_6$ is;

$$X1=a+2b+c$$

The insulation length X1 is between $E_1$ and $E_6$(or $E_5$), and (a) is the depth of the hole 16*a* or the length between $E_2$ (bottom of the hole 16*a*) and $E_5$ (bottom of the cylindrical tube 16), (b) is the height of the cylindrical tube 16 or the length between $E_4$ and $E_5$, and (c) is the radius of the tube 16 or the glass tube 32, or the length between $E_1$ (center of the hole 22*b*) and $E_6$ (or $E_5$). The base structure is connected to the ground potential at the point close to the point $E_6$ through springs 11 of a socket.

It should be appreciated that the insulation length X1 may be enough for desired withstand voltage by designing the height of the cylindrical tube 16 of the first base component 22.

In one modification of the present invention, the discharge lamp 15 is covered with a transparent glass tube 32 which engages with said cylindrical tube 16. The presence of the tube 32 increases the insulation length X1.

The point $E_1$ is defined to be the bottom center of the hole 16*a*, the point $E_2$ is defined to be the peripheral of the bottom of the hole 16*a*, the points $E_3$ and $E_4$ are top of the cylindrical tube 16, the point $E_5$ is the outer point at the bottom of the cylindrical tube 16, and the point $E_6$ is the bottom of the glass tube 32. When no glass tube 32 is provided, the point $E_5$ coincides with the point $E_6$ when we consider the insulation length X1.

The insulation length X2 between the positive lead line 20 and the negative lead line 17 is the total length from the point $G_1$ to the point $G_7$ through $G_2$ through $G_6$ as shown by dotted line in FIG. 2, and is almost twice of the height (d) of the first partition wall 21 or the second partition wall 29. Therefore, it should be appreciated that the insulation length X2 is increased by the presence of the first partition wall 21 and the second partition wall 29.

The point $G_1$ is defined to be the bottom of the hole 22*b*, the points $G_2$ and $G_3$ are bottom of the first partition wall, the points $G_4$ and $G_5$ are top of the second partition wall, the point $G_6$ is the peripheral of a large hole under the thin hole 22*c*, and the point $G_7$ is the bottom center of the thin hole 22*c*.

In the present invention, both the insulation length X1 and the insulation length X2 are in the range between 20 mm and 30 mm, the first base component 22 is made of densed steatite ceramics having the main crystallization ($MgO.SiO_2$) which is conventionally used for insulation material for high frequency signal, and the second base component 30 is made of plastics which is superior for insulation.

Therefore, the present base structure has the withstand voltage higher than 20000 volts, and a discharge lamp is used with voltage higher than 20000 volts.

Further, it should be appreciated that the base structure 14 is designed in structure and size so that it is compatible with a socket for a conventional filament type lamp.

Figure 8:
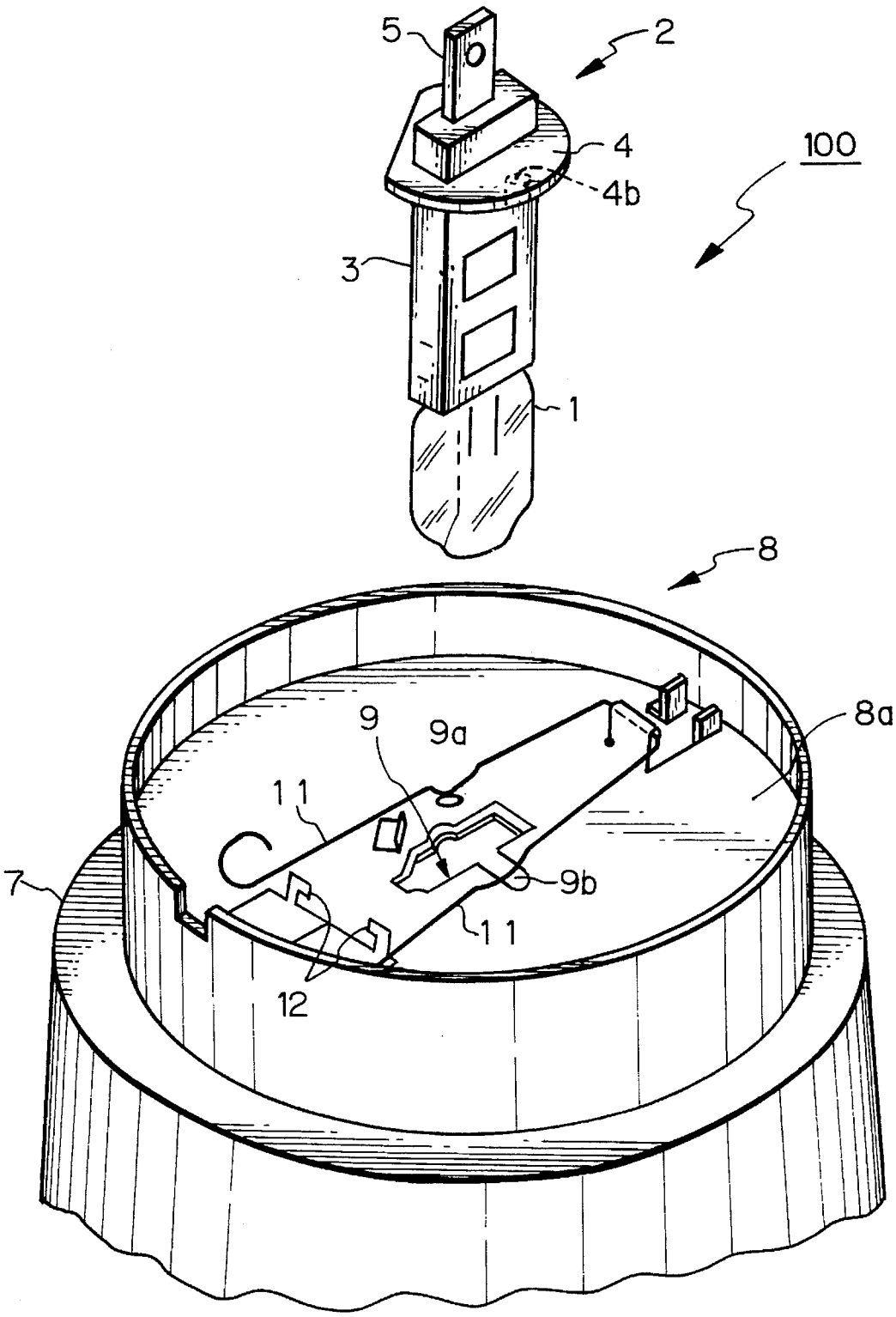
Fig. 8 PRIOR ART
FIG. 8 shows a partial perspective view of a prior halogen lamp, and a prior socket of H-1 filament type halogen lamp.

The shape of the circular flange 24 with the cut out portion K with a pair of projections 34*a* and 34*b* is determined so that a lamp is compatible with a socket for a conventional H-1 filament type lamp (see FIG. 8).

Figure 4:
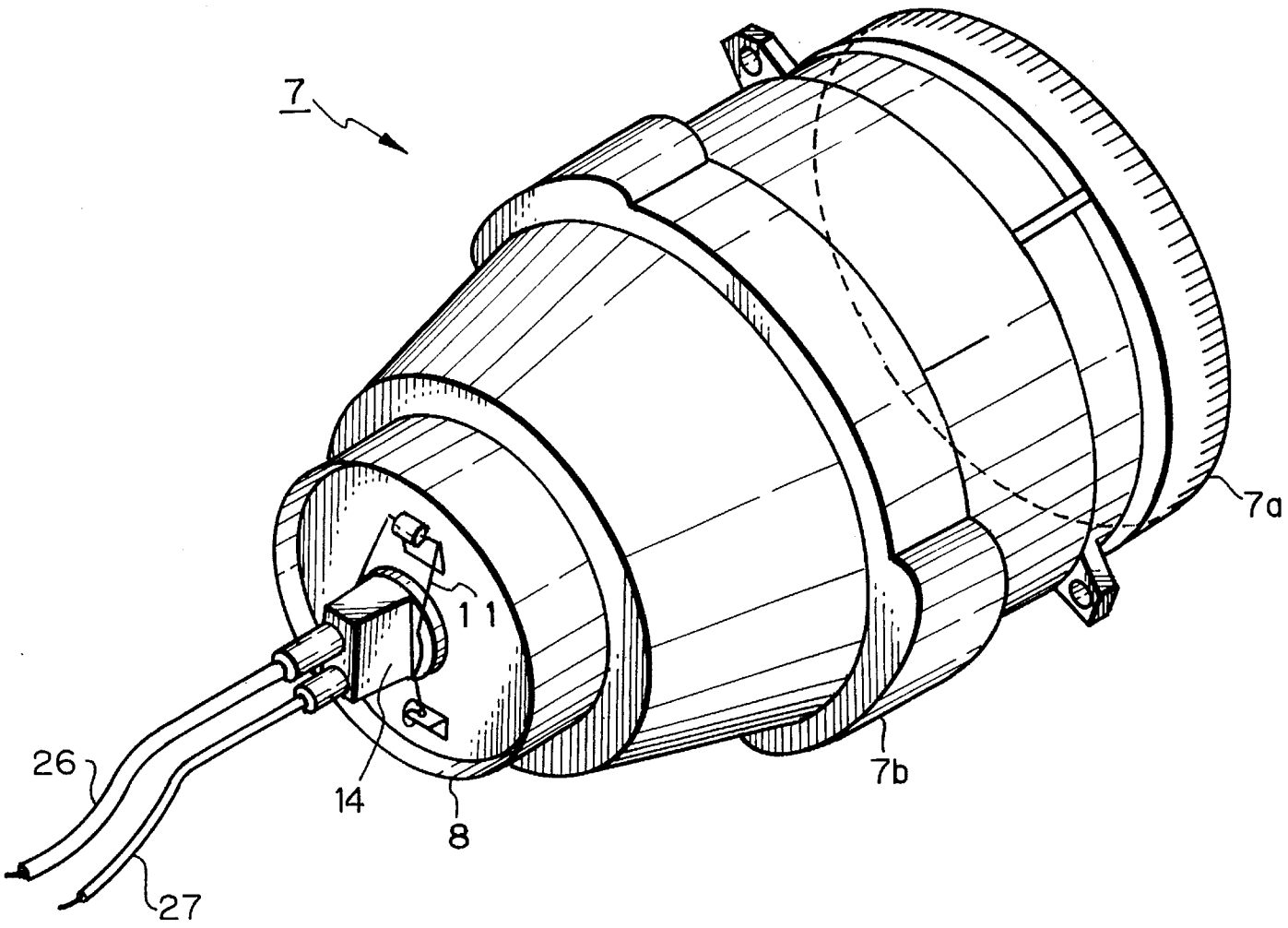
FIG. 4 shows a perspective view of the present discharge lamp assembly mounted in a conventional socket for a H-1 filament type halogen lamp.

FIG. 4 shows a perspective view of a lamp assembly in which a discharge lamp having the present base structure is coupled with a conventional H-1 filament type head light. In the figure, the numeral 7 is a socket assembly, 7*a* is a front lens, 7*b* is a lamp body, 8 is a socket, 14 is the present base structure of FIGS. 1 and 2, 11 is a spring for fixing the lamp assembly to the socket 8. The numerals 26 and 27 are external lead lines of a discharge lamp. The spring 11 in FIG. 4 is the same as that of FIG. 8. It should be appreciated that a discharge lamp 15 of the lamp assembly is behind the socket 8, and it is not shown in FIG. 4.

As mentioned above, the present discharge lamp assembly is compatible with a conventional filament type lamp, and is used in a conventional socket assembly.

Figure 3:
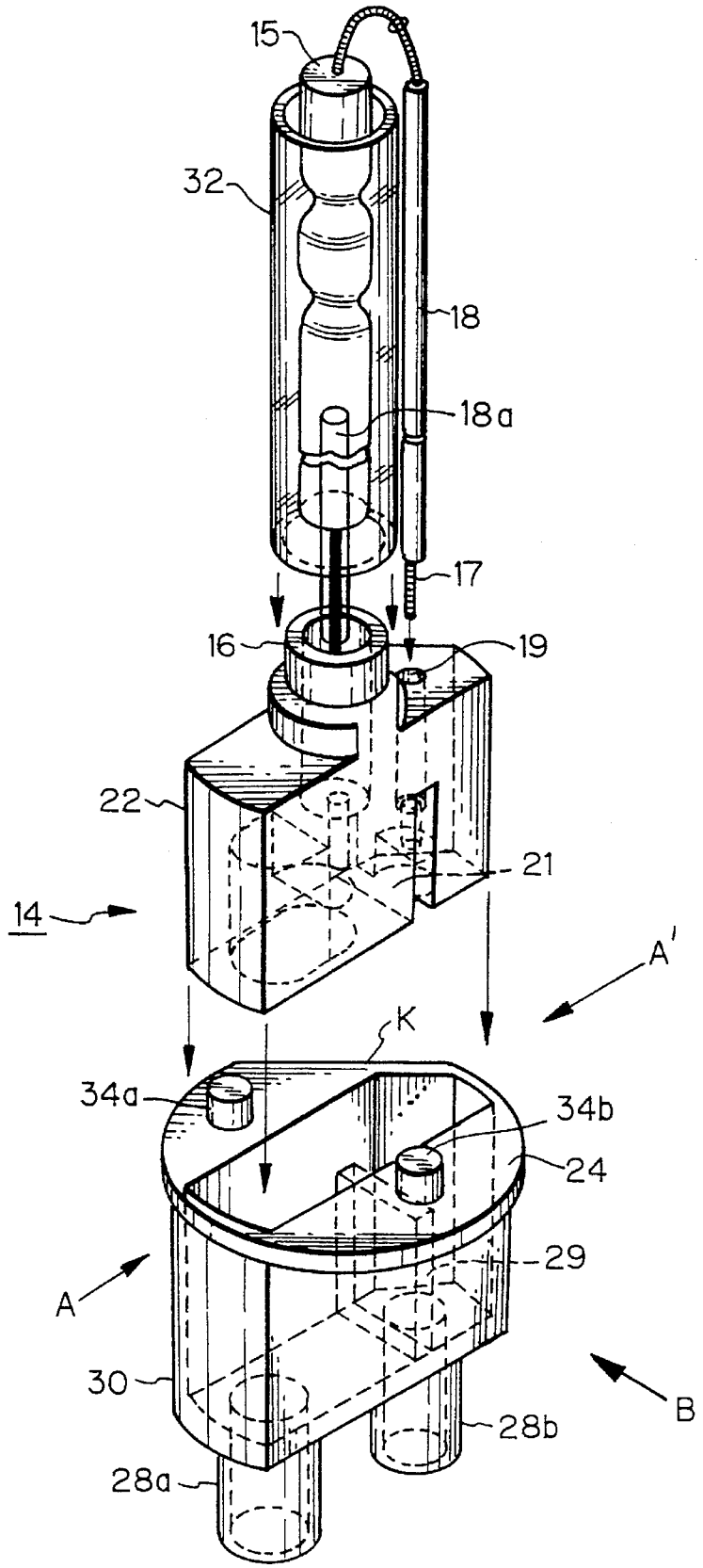
FIG. 3 shows modification of the structure of FIG. 1.

FIG. 3 shows the modification of the discharge lamp assembly of FIGS. 1 and 2. The feature of FIG. 3 is the presence of an insulation tube 18*a* which is preferably transparent, and coveres the positive lead line 20 in the discharge lamp 15. The tube 18*a* is coupled with the bottom of the cylindrical tube 16 or the point $E_1$. The presence of the tube 18*a* increases the insulation length X1, because the insulation length $E_1E_2$ is converted to the length from $E_1$ to the top of the tube 18*a*, plus the length from the top of the tube 18*a* to $E_2$. Preferably, the height of the tube 18*a* is longer than the height of the cylindrical tube 16.

Figure 5:
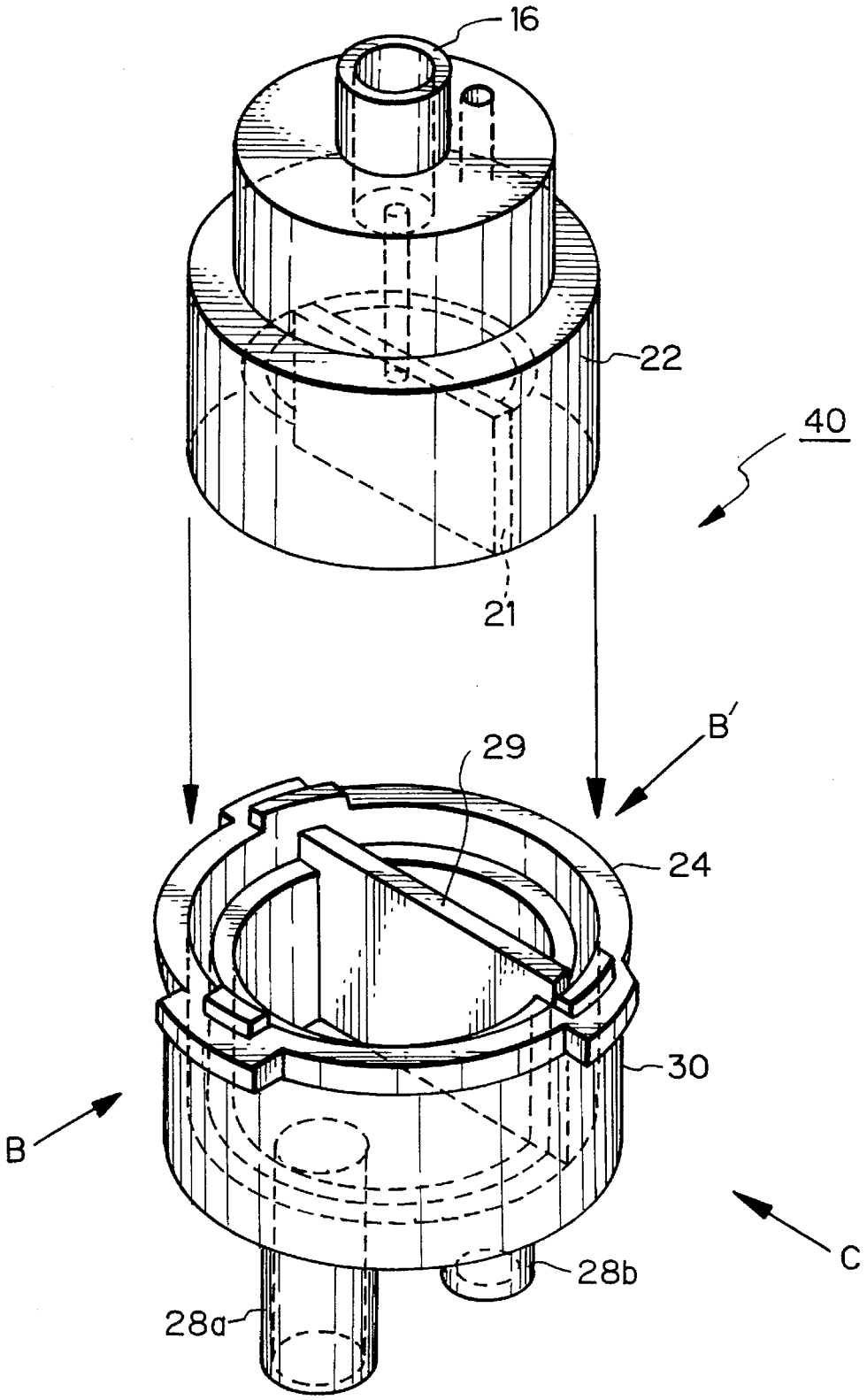
FIG. 5 shows structure of a base for a discharge lamp assembly which is compatible with HB-3 and/or HB-4 type halogen lamp for a filament type head light.

FIG. 5 shows a perspective view of a base structure of a discharge lamp assembly in the second embodiment of the present invention. It is compatible with HB-3 or HB-4 filament type lamp system.

Figure 6:
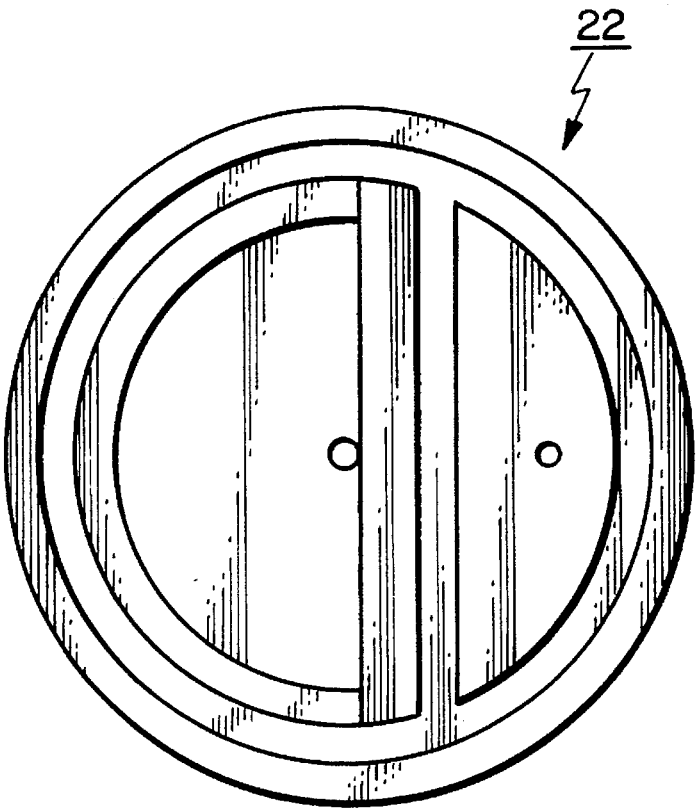
FIG. 6 shows structure of a first base component of the base structure of FIG. 5.
Figure 6:
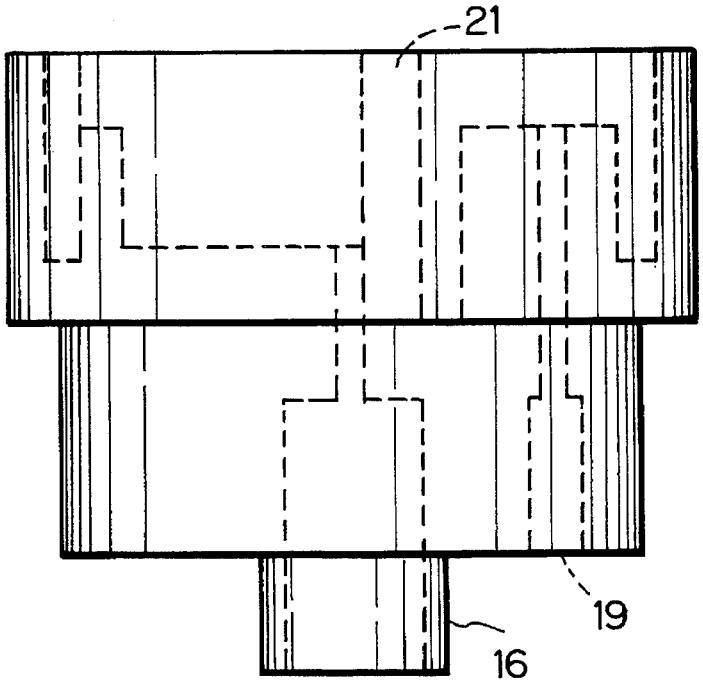

FIG. 6 shows the bottom view and the side view of the first base component 22 of FIG. 5.

Figure 7:
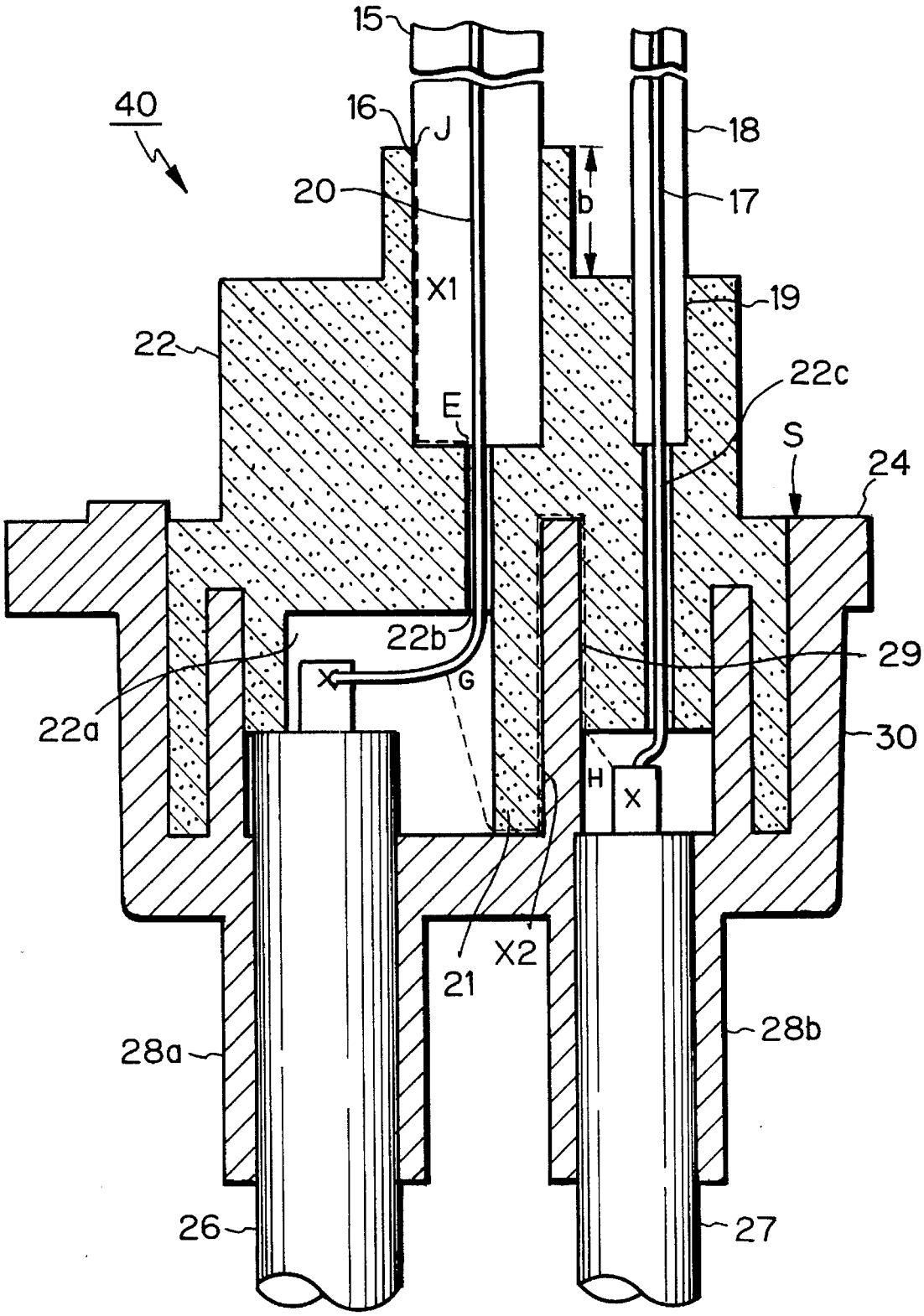
FIG. 7 shows cross section of a base structure of FIG. 5.

FIG. 7 is a cross section along B—B' viewing from the arrow C in FIG. 3.

In those figures, the same numerals as those in FIGS. 1 and 2 show the same members.

The base structure 40 for a head light for a vehicle has a first base component 22, and a second base component 30.

The first base component 22 is made of ceramics essentially in circular cylindrical shape, and has a cylindrical tube 16 for accepting a discharge lamp 15 at the center of the first base component 22. The holes 22*a*, 22*b* and 22*c* are provided similar to the structure of FIGS. 1–3. The hole 22*b* is provided under the cylindrical tube 16 and accepts a positive lead line 20 of the discharge lamp 15. The hole 22*c* has a cylindrical wide portion 19 at the top of the same for accepting and fixing a thin ceramics tube 18 which covers a negative lead line 17. The first base component 22 has a first partition wall 21 at a side of the center hole 22*b* for separating and insulating between a positive lead line 20 of a discharge lamp and a negative lead line 17 in the ceramics tube 18.

The second base component 30 is made of plastics so that it engages with the first base component 22, and has a circular flange 24. The second base component 30 has a second partition wall 29 for separating and insulating between a positive lead line 20 of a discharge lamp and a negative lead line 17 (and an external negative lead line 27). The second partition wall 29 contacts with the first partition wall 21 when two base components are assembled. The second base component 30 has cylindrical tubes 28*a* and 28*b* for accepting an external positive lead line 26 and an external negative lead line 27. The second base component 30 engages with the first base component 22 so that the latter is inserted into the former. The diameter of the flange 24 is 30 mm in the embodiment.

As shown in the figures, the first base component 22 and the second base component 30 have a pair of coaxial outer walls. The first partition wall 21 and the second partition wall 29 contact with each other.

The partition walls 21 and 29, operates, together with a pair of coaxial outer walls, to increase the insulation length X2 between the negative lead line 17 and the positive lead line 20.

The height (b) of the cylindrical tube 16 which accepts a discharge lamp 15 operates to increase the insulation length X1 between E and J in FIG. 7. Therefore, the insulation length X1 is designed so that the desired withstand voltage is obtained by properly designing the height (b).

Further, an insulation glass tube 32 covering a discharge lamp 15, accepted in the cylindrical tube 16, increases the insulation length X1, as is the case of the first embodiment of FIGS. 1–2.

Further, a glass tube 18*a* covering the positive lead line 20 as is the case of FIG. 3 increases the insulation length X1.

Therefore, it should be noted that the insulation length X1 depends upon an insulation glass tube 32, and the height (b) of a cylindrical tube 16. So, the structure of a base of a discharge lamp is designed considering the insulation length X1, together with other design conditions, including the size of the first base component 22, the strength and the shape of ceramics, whether the insulation glass tube 32 is used or not, et al.

The discharge lamp assembly having the base structure according to the present invention is compatible with a conventional halogen lamp assembly, and has the same length LCL (light center length) between the reference plane S (plane of flange) of the base structure and the center of light as that of a conventional halogen lamp. The size of the base structure of the present invention satisfies the standard of the conventional technical standard for a conventional halogen lamp, so that the present discharge lamp is compatible with a conventional halogen lamp.

It should be appreciated that the present invention is not restricted to a head light for a vehicle, but is used in any discharge lamp.

As described above in detail, the present invention has at least the following effects.

(1) It is small in size, and has sufficient insulation characteristics having withstand voltage higher than 20000 volts for operating a discharge lamp.

(2) The present discharge lamp is compatible with a conventional filament type head light, and is inserted in a socket for a conventional lamp.

From the foregoing it should be appreciated that a new and improved discharge lamp assembly has been found. It should be understood of course that the embodiments disclosed are merely illustrative and are not intended to limit the scope of the invention. Reference should be made, therefore, to the appended claims for indicating the scope of the invention.

What is claimed is:

1. A discharge lamp assembly having a discharge lamp and a base structure for securing said discharge lamp, said base structure comprising;

a first base component made of integral ceramics comprising a cylindrical tube having a predetermined height at center of said first base component for accepting said discharge lamp at one side of the first base component; a first hole at a bottom of another side of said first base component for accepting an external positive lead wire; a second hole under said cylindrical tube for accepting a positive lead wire of said discharge lamp; a third hole for accepting a negative lead wire of the discharge lamp; a first partition wall provided between said second hole and said third hole for insulating the positive lead wire and said negative lead wire, said first base component including a slit between said second hole and said third hole adjacent to side of said first partition wall; said base structure further comprising a second base component made of integral plastics for engaging with said first base component, said second base component comprising a circular flange and a housing under said flange having a bottom plate for accepting said first base component; a pair of tubes under said bottom plate for accepting said positive and negative lead wires for said discharge lamp, and a second partition wall (29) for insulating said positive lead wire and said negative lead wire so said second partition wall engages with said slit;

wherein a first distance between said positive lead line and an outer surface of the base structure, and a second distance between said positive lead wire and said negative lead wire, are in a range between 20 mm and 30 mm, and wherein said base structure is configured to engage with a filament type vehicle headlamp.

2. A discharge lamp assembly according to claim 1, further comprising a hollow tube made of transparent glass covering said discharge lamp so that said hollow tube is inserted into said cylindrical tube.

3. A discharge lamp assembly according to claim 1, wherein said discharge lamp is for a headlamp for a vehicle.

4. A discharge lamp assembly according to claim 1, wherein said first distance and said second distance provide a sufficient insulating effect to withstand voltage up to 22000 volts.

5. A discharge lamp assembly according to claim 1, further comprising a transparent glass tube covering said positive lead wire.

6. A discharge lamp assembly according to claim 1, wherein the lamp assembly is compatible with an H-1 type lamp.

7. A discharge lamp assembly according to claim 1, wherein the lamp assembly is compatible with an HB-3/HB-4 type lamp.

8. A discharge lamp assembly according to claim 1, wherein said flange has a pair of projections which engage with holes of a socket for positioning of the lamp assembly.

9. A discharge lamp assembly according to claim 1, wherein said negative lead wire is covered with a thin ceramics tube between a top of said discharge lamp and said first base component.

10. A discharge lamp assembly according to claim 1, wherein a hole is provided in said first base component under said cylindrical tube, and said discharge lamp is positioned at the bottom of the hole.

* * * * *